United States Patent [19]

Stone

[11] Patent Number: 4,599,058

[45] Date of Patent: Jul. 8, 1986

[54] VANE SLOTS FOR A FLUID POWER CONVERTER

[75] Inventor: Stephen R. Stone, San Antonio, Tex.

[73] Assignee: Rineer Hydraulics, Inc., Corpus Christi, Tex.

[21] Appl. No.: 646,661

[22] Filed: Aug. 31, 1984

[51] Int. Cl.[4] ..... F04C 18/00

[52] U.S. Cl. ..... 418/221; 418/268

[58] Field of Search ..... 418/221, 234, 243, 222, 418/223, 259, 266–270

[56] References Cited

U.S. PATENT DOCUMENTS

| | | | |
|---|---|---|---|
| 784,614 | 3/1905 | Buchanan | 418/269 |
| 3,211,104 | 10/1965 | Rosaen | 418/268 |
| 3,221,665 | 12/1965 | Hartmann | 418/268 |
| 3,450,108 | 6/1969 | Rich | 418/268 |
| 3,782,867 | 1/1974 | Gerlach et al. | 418/82 |
| 3,957,404 | 5/1976 | Gerlach | 418/150 |

FOREIGN PATENT DOCUMENTS

| | | | |
|---|---|---|---|
| 103202 | 11/1962 | Netherlands | 418/267 |

*Primary Examiner*—Carlton R. Croyle
*Assistant Examiner*—Jane E. Obee
*Attorney, Agent, or Firm*—Fulbright & Jaworski

[57] ABSTRACT

In a fluid power converter, such as a hydraulic pump or motor, having a rotor and stator with vanes in both the rotor and stator, the improvement in the vane slots on one or both of the rotor and stator in which a ramp is provided on both sides of the open ends of each slot. The ramps are directed outwardly towards the annular space between the rotor and stator for allowing a crossing vane to cam out of the opposing slot thereby preventing the crossing vane from catching in the opposing slot.

6 Claims, 4 Drawing Figures

VANE SLOTS FOR A FLUID POWER CONVERTER

BACKGROUND OF THE INVENTION

It is well known that hydraulic motors and pumps which have vane elements in both the rotor and stator under certain conditions can have interference problems as the rotor vanes and the stator vanes cross each other. These problems become more acute at higher speeds and/or higher loading. Various improvements have been suggested in the past to avoid the destructive detenting of the stator and rotor vanes with respect to each other and their slots in order to prevent vane locking, detenting, and minimizing wear. In U.S. Pat. No. 3,782,867, rotor and stator vanes having different thicknesses are provided with hydraulic and spring loading. In U.S. Pat. No. 3,957,404, improvements in the shape and size of the rotor and stator vane tips are disclosed. Thicker vanes, when they cross a thinner vane, are less likely to catch in the slot of the thinner vane. However, the thicker vane can lose its biasing pressure or can wear and allow the thinner vane to enter into and catch in the slot of the thicker vane. Another prior art solution was to make the thicker vane have the same depth as its vane slot so that it could not retract far enough into its slot to allow the thinner vane to enter the slot of the thicker vane. However, this required that the bottom of the thicker vane slot be flat and created manufacturing difficulties. Still the outer end of the thicker vane could wear and allow the thinner vane to catch. Therefore, in spite of all of the suggested solutions, the problem of destructive detenting of the stator and rotor vanes with respect to each other and their respective slots has not been entirely solved and remains a problem particularly at high loads, high speeds, and overrunning.

The present invention is directed to shaping the vane slots of one or both of the rotor and stator for preventing the catching of the opposing vanes in the vane slots.

SUMMARY

The present invention is directed to a fluid power converter having a rotor and stator, the members being concentrically mounted and rotatable one with respect to the other about a common center. The members have opposing peripheries contoured to provide an annular space therebetween and each of the peripheries include a plurality of spaced radially extending slots receiving a vane therein. A fluid inlet is provided in the stator adjacent one side of each stator slot and opens into the annular space, and a fluid outlet is provided in the stator adjacent the second side of each stator slot and opens into the annular space. The improvement is directed to a ramp on at least one of the rotor and stator on at least one side of the open ends of each slots. The ramps are directed outwardly towards the annular space for allowing a crossing vane to cam out of opposing the slot instead of catching therein.

Still a further object of the present invention is wherein the slots in both the stator and rotor include ramps on each side of each slot.

A still further object is wherein the ramps are flat and at an angle of approximately ten to less than ninety degrees and preferably seventy degrees to the longitudinal axis of the radially extending slots.

Still a further object is the provision wherein the ramps are rounded.

Yet a still further object of the present invention is wherein the vanes in one of the rotor and stator members are thicker than the vanes in the other member and a ramp is provided on the member having the thicker vanes on both sides of the open end of each slot. The ramps are directed outwardly towards the annular space for allowing a crossing thinner vane on the other member to cam out of the thicker slot without catching.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENT

While the improved vane slots of the present invention will be described in connection with one type of fluid power converter for purposes of illustration only, the vane slots of the present invention may be utilized in other and various types of fluid power converters.

Figure 1:
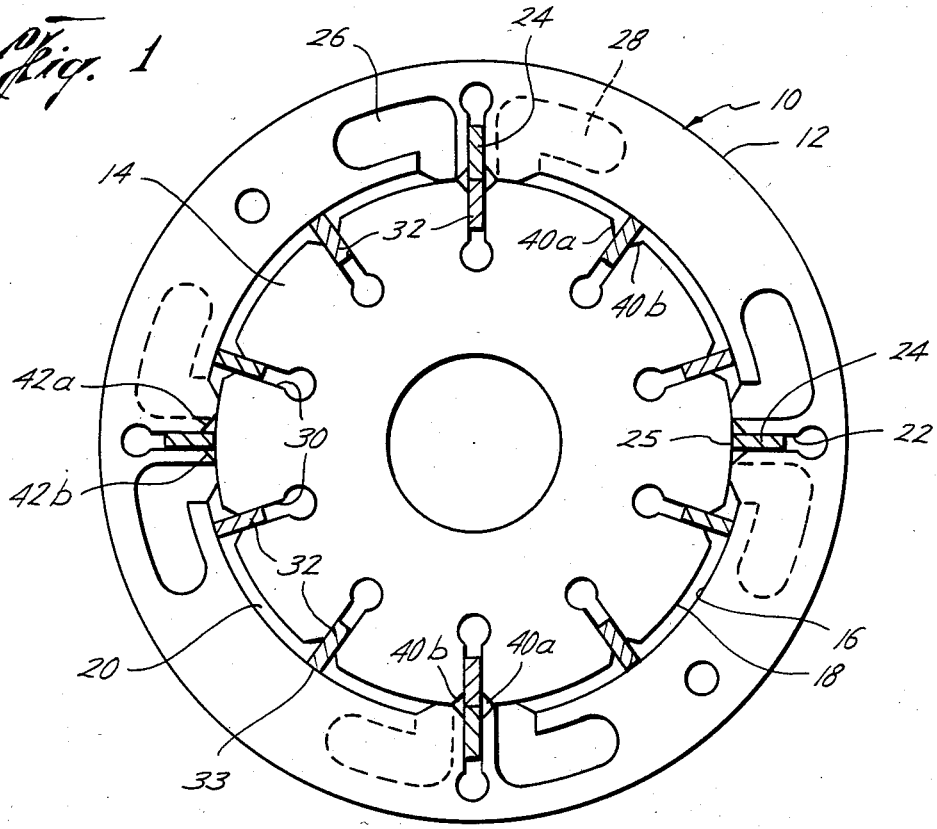
FIG. 1 is a schematic elevational view, in cross section, illustrating the fluid power converter utilizing the improved vane slots of the present invention.

Referring now to the drawings and particularly to FIG. 1, the reference numeral 10 generally indicates a fluid power converter, for example, a hydraulic motor or pump in which the member 12 may be the stator and the member 14 may be the rotor wherein the inner periphery 16 of the stator 12 and the outer periphery 18 of the rotor 14 may be suitably contoured to provide an annular fluid space 20 therebetween. The stator 12 includes a plurality of radially extending vane slots 22 each of which receives a vane element 24 whose outer edge or tip 25 contacts the outer periphery 18 of the rotor 14. The rotor 14 also includes radially extending vane receiving slots 30 which receives vane elements 32 therein having an outer edge or tip 33 which engages the inner periphery 16 of the stator 12.

Fluid passageways 26 and 28 are provided on either side of the vane elements 24 and the stator 12, one of which, such as passageway 26, may be a fluid inlet and the other passageway, such as passageway 28, may be a fluid outlet. Thus assuming that the fluid power converter 12 is acting as a motor with the fluid coming out of the passageways 28, into the fluid space 20, and into the passageway 26, the rotor 14 will rotate counterclockwise relative to the stator 12.

However, a problem generally encountered in fluid power converters having vanes in a slot in both the rotor and stator is the interaction between the vanes and slots on the rotor and the vanes and slots on the stator. That is, as the rotor 14 and and stator 12 rotate relative to each other the vane 32 on the rotor 14 will cross the vanes 24 on the stator 12. Even with spring and hydraulic loading on the back of the vanes 24 and 32, as described in U.S. Pat. No. 3,782,867, the vanes may catch or engage in the opposing slot. That is, the vanes 24 on the stator 12 may push the vanes 32 inwardly in the slot 30 and catch in the slot 30. Similarly, the vanes 32 may push the vanes 24 outwardly and the vanes 32 may catch in the slots 22 in the stator 12. And, of course, the vanes may enter into an opposing slot in the event that the opposing vane is worn down. The result is that the vanes may be destroyed or the peripheries 16 and 18 may be chipped, wear increased, the vanes may lock, or detenting may occur.

Both the rotor vane slots and the stator vane slots are currently cut directly into the peripheries 18 and 16, respectively, leaving sharp corners at the intersection of the slots 22 and the periphery 16 of the stator 12 and at the intersection of the slots 30 and the periphery 18 of the rotor 14. The present invention is directed to providing a ramp or cam on one or both sides of the slots in order to allow the opposing vane to cam out of the slots in spite of the extent or wear of the opposing vane or the amount of pressure acting on the opposing vane. Thus, referring now to FIGS. 1 and 2, a ramp 40*a* and 40*b* are provided on opposite sides of each vane slot 30 in the rotor 14. Similarly, ramps 42*a* and 42*b* may be provided on each side of the vane slots 22 in the stator 12. Thus, the vanes 32 in the rotor 12 cannot catch in the vane slots 22 in the stator 12, but will be cammed out of the slots 22 and back onto the periphery 16 of the stator 12. Similarly, the vanes 24 in the stator 12 will engage the ramps 40*a* and 40*b* in the rotor 14 thereby avoiding locking or engaging sharp edges in the vane slots 30 in the rotor 14. It is preferable that ramps be provided on both sides of the slots 22 and 30, so that the converter 10 may be bidirectional and operate in either direction. However, for a converter 10 that operates in a single direction, ramps need be provided only on the trailing edges of the slots. Thus assuming that the rotor 14 operates in the counterclockwise direction only, only the ramps 40*b* and 42*b* need be provided and thus ramps 40*a* and 42*a* may be omitted.

Figure 2:
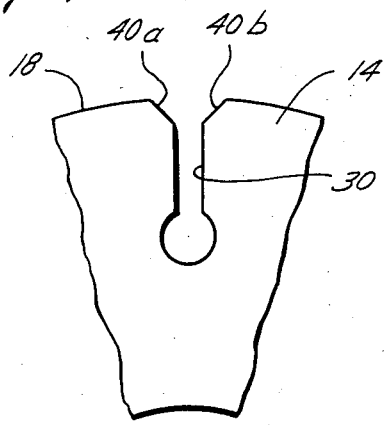
FIG. 2 is an enlarged fragmentary cross-sectional view of one form of vane slot.
Figure 3:
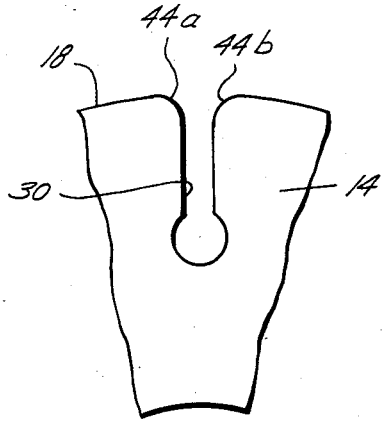
FIG. 3 is an enlarged fragmentary cross-sectional view of another form of a vane slot.

In FIGS. 1 and 2, the ramps 40*a* and 40*b* are flat shaped, preferably at an angle between ten and less than ninety degrees and preferably approximately seventy degrees, to the longitudinal axis of the vane slots. Of course they can be of any suitable geometric shape such as rounded, such as the ramps shape 44*a* amd 44*b* in FIG. 3, which allows the opposing vane to cam back out of the vane slots.

Figure 4:
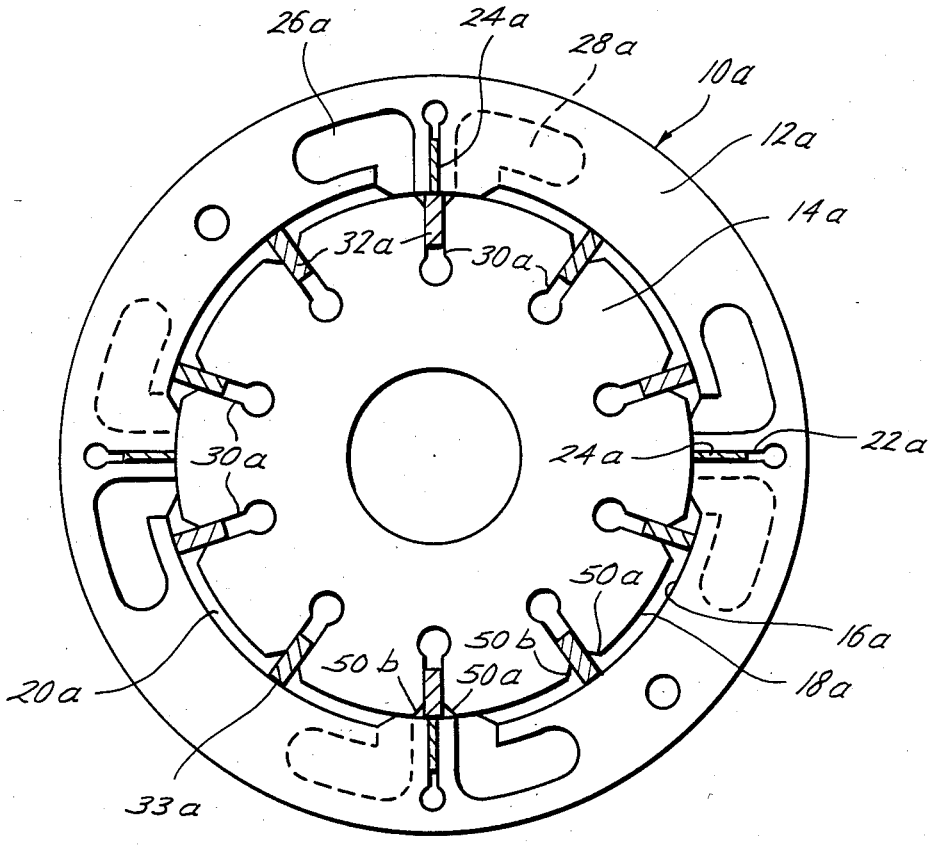
FIG. 4 is a schematic elevational view, in cross section, illustrating a fluid power converter having thicker vanes in the rotor and thinner vanes in the stator and utilizing the present improved vane slot.

In FIG. 1, the vanes 24 and 32 were of both the same thickness and therefore it is important that the ramps 40*a*, 40*b*, 42*a* and 42*b* be added both to the rotor slots 30 and the stator slots 22, respectively. However, in other embodiments in which for some reason such as size, it may be only necessary to have the ramps on one of the members 12 and 14. Referring now to FIG. 4, a further embodiment of the present invention is shown wherein like parts similar to those in FIG. 1 are similarly numbered with the addition of the suffix "a". FIG. 4 shows a fluid power converter 10*a* in which the vanes 32*a* and the vane slots 30*a* in the rotor 14*a* are thicker than the vanes 24*a* in the slots 22*a* in the stator 12*a*. Because the thicker vanes 32*a* in the rotor 14*a* are unlikely to become caught in the thinner slot 22*a* in the stator 12*a*, it is not necessary to provide ramps on the sides of the slots 22*a*. However, because the thinner vanes 24*a* can easily become caught in the thicker vane slots 30*a* in the rotor 14*a*, in the event that the outer edges 33*a* of the vanes 32*a* wear down or in the event that any biasing force behind the vanes 32*a* fails, ramps 50*a* and 50*b* on opposite sides of the open ends of each of the slots 30*a* are provided and the ramps 50*a* and 50*b* are directed outwardly towards the annular space 20 for allowing a crossing vane 24*a* to cam out of the slots 30*a*. Thus the vanes 24*a* will ride in and out of the slots 30*a* and wearing of the outer ends 33*a* of the vanes 32*a* or loss of hydraulic loading can be tolerated. For only counterclockwise rotation of the rotor 14*a*, only the ramps 50*b* are needed.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skilled in the art and which are encompassed within the spirit of the invention and the scope of the appended claims.

What is claimed is:

1. In a fluid power converter having a rotor and a stator member, the members being concentrically mounted and rotatable one with respect to the other about a common center, said members having opposing peripheries contoured to provide an annular space therebetween, each of said peripheries including a plurality of spaced radially extending slots receiving a vane therein, each of said vanes having sides which are entirely straight a fluid inlet in the stator adjacent one side of each stator slot and opening into the annular space, a fluid outlet in the stator adjacent the second side of each stator slot and opening into the annular space, the improvement comprising, a ramp on at least one of the rotor and stator on the trailing sides of the open ends of each slot, said ramps being directed outwardly towards the annular space for allowing a crossing vane to cam out of the slot.

2. In a fluid power converter having a rotor and a stator member, the members being concentrically mounted and rotatable with respect to the other about a common center, said members having opposing peripheries contoured to provide an annular space therebetween, each of said peripheries including a plurality of spaced radially extending slots receiving a vane therein, the vanes in one of the members being thicker than the vanes in the other member each of said vanes having sides which are entirely straight, a fluid inlet in the stator adjacent one side of each slot and opening into the annular space, a fluid outlet in the stator adjacent the second side of each slot and opening into the annular space, the improvement comprising, a ramp on the member having the thicker vanes on both sides of the open end of each slot, said ramps being directed outwards towards the annular space for allowing a crossing thinner vane on the other member to cam out of the slot.

3. In a fluid power converter having a rotor and a stator member, the members being concentrically mounted and rotatable one with respect to the other about a common center, said members having opposing peripheries contoured to provide an annular space therebetween, each of said peripheries including a plurality of spaced radially extending slots receiving a vane therein, each of said vanes having sides which are entirely straight a fluid inlet in the stator adjacent one side of each stator slot and opening into the annular space, a fluid outlet in the stator adjacent the second side of each stator slot and opening into the annular space, the improvement comprising, a ramp on at least one of the rotor and stator on both sides of the open ends of each slot, said ramps being directed outwardly towards the annular space for allowing a crossing vane to cam out of the slot.

4. The apparatus of claim 3 wherein the slots on both the rotor and stator includes said ramps.

5. The apparatus of claim 3 wherein the ramps are flat and at an angle of approximately ten to ninety degrees to the longitudinal axis of said radially extending slots.

6. The apparatus of claim 3 wherein the ramps are rounded.

* * * * *